US011851932B2

(12) United States Patent
Fava et al.

(10) Patent No.: US 11,851,932 B2
(45) Date of Patent: Dec. 26, 2023

(54) DOOR WITH AUTOMATIC OPENING AND CLOSING

(71) Applicant: SOEMA SRL, Recanati (IT)

(72) Inventors: Enzo Fava, Recanati (IT); Giuseppe Manfredini, Recanati (IT)

( * ) Notice: Subject to any disclaimer, the term of this patent is extended or adjusted under 35 U.S.C. 154(b) by 373 days.

(21) Appl. No.: 17/335,374

(22) Filed: Jun. 1, 2021

(65) Prior Publication Data

US 2021/0381296 A1 Dec. 9, 2021

(30) Foreign Application Priority Data

Jun. 3, 2020 (IT) ..... 102020000013159

(51) Int. Cl.
*E05F 15/00* (2015.01)
*E05F 15/614* (2015.01)
(Continued)

(52) U.S. Cl.
CPC ..... *E05F 15/614* (2015.01); *E05B 47/0012* (2013.01); *E05B 63/0069* (2013.01);
(Continued)

(58) Field of Classification Search
CPC ..... E05F 15/603; E05F 15/614; E05F 15/605; E05F 15/632; E05F 15/73; E05F 15/70; E05F 15/00; E05F 11/50; E05B 47/0012; E05B 2047/0013; E05B 2047/0014; E05B 2047/0017; E05B 2047/002; E05B 63/0069; E05B 65/0035; E05B 2047/0069; E05Y 2201/216; E05Y 2201/214; E05Y 2201/266; E05Y 2201/434; E05Y 2201/438; E05Y 2201/716;
(Continued)

(56) References Cited

U.S. PATENT DOCUMENTS 5,878,530 A * 3/1999 Eccleston ..... E05F 15/63 49/340
6,634,140 B1 * 10/2003 Sellman ..... E05F 15/63 49/340
(Continued)

FOREIGN PATENT DOCUMENTS

EP 2017423 A1 1/2009
GB 2264534 A 9/1993
(Continued)

*Primary Examiner* — Chi Q Nguyen
(74) *Attorney, Agent, or Firm* — Egbert, McDaniel & Swartz, PLLC

(57) ABSTRACT

Door with automatic opening and closing, including a door panel, a support column fixed to the door panel and suitable for rotating around its longitudinal axis in such a way to move the door panel between two end-of-travel positions, an electric motor for actuating the support column and a drive unit for transmitting the motion from the electric motor to the support column. The drive unit has a first drive element connected to the electric motor and a second drive element connected to the support column, wherein the drive unit includes a clutch unit that is interposed between the first drive element and the electric motor or between the second drive element and the support column. The door also has an automatic lock that completes the automation of the door by detectors.

11 Claims, 13 Drawing Sheets

(51) Int. Cl.

| | |
|---|---|
| ***E05B 47/00*** | (2006.01) |
| ***E05B 63/00*** | (2006.01) |
| *E05F 15/73* | (2015.01) |
| *E05B 65/00* | (2006.01) |

(52) U.S. Cl.
CPC ... *E05B 65/0035* (2013.01); *E05B 2047/0069* (2013.01); *E05F 15/73* (2015.01); *E05Y 2201/216* (2013.01); *E05Y 2201/266* (2013.01); *E05Y 2201/434* (2013.01); *E05Y 2201/718* (2013.01); *E05Y 2400/40* (2013.01); *E05Y 2900/112* (2013.01)

(58) Field of Classification Search
CPC ..... E05Y 2201/718; E05Y 2201/72; E05Y 2400/40; E05Y 2900/00; E05Y 2900/112
See application file for complete search history.

(56) References Cited

U.S. PATENT DOCUMENTS

| | | | | |
|---|---|---|---|---|
| 8,390,219 | B2 * | 3/2013 | Houser | E05F 15/40 318/400.38 |
| 8,564,235 | B2 * | 10/2013 | Burris | F03G 7/08 318/467 |
| 8,773,237 | B2 * | 7/2014 | Burris | E05F 3/227 324/130 |
| 9,523,230 | B2 * | 12/2016 | Burris | E05F 3/227 |
| 9,574,389 | B2 * | 2/2017 | Menze | E05B 1/0053 |
| 11,142,939 | B2 * | 10/2021 | Plummer | E05F 15/63 |
| 11,174,664 | B2 * | 11/2021 | Sellinger | E05F 15/611 |
| 11,220,853 | B2 * | 1/2022 | Cumbo | E05F 15/41 |
| 11,585,143 | B1 * | 2/2023 | Iriarte | E05F 15/60 |
| 11,661,786 | B2 * | 5/2023 | Langenberg | E05F 15/73 49/31 |
| 11,713,609 | B2 * | 8/2023 | Leonard | E05F 15/622 49/324 |

FOREIGN PATENT DOCUMENTS

| | | | |
|---|---|---|---|
| GB | 2345087 | A | 6/2000 |
| KR | 20020010284 | A | 2/2002 |
| KR | 102015902 | B1 | 8/2019 |

* cited by examiner

DOOR WITH AUTOMATIC OPENING AND CLOSING

CROSS-REFERENCE TO RELATED APPLICATIONS

Not applicable.

BACKGROUND OF THE INVENTION

1. Field of the Invention

The present patent application relates to a door with automatic opening and closing. The field of reference of the present invention is that of automated doors suitable for being installed in public bathrooms, where such doors usually have a door panel with a low thickness (12/14 mm) made from low thickness-panels (HPL-Glass-Stoneware).

2. Description of Related Art Including Information Disclosed Under 37 CFR 1.97 and 37 CFR 1.98

The automated doors installed in public bathrooms have several advantages compared to ordinary manual doors.

The first one is a hygienic advantage: in the presence of an automated door, users do not need to touch the door panel or the elements connected to the door (such as knobs and handles) with their hands. In fact, the door handles of public bathrooms are used by a multitude of people with different hygienic habits and are an important source of transmission of germs, bacteria or microbes.

Moreover, another advantage of said doors is that they guarantee access to the bathroom to as many people as possible, with special reference to users with motor disabilities, who normally find it difficult to move the door panel with their hands. Therefore, said automated doors can remove the so-called architectural barriers.

An ordinary automatic door comprises a door panel, an electric motor for moving the door panel, and a drive unit for transmitting the motion from the electric motor to the door panel, which is moved by the electric motor during opening and closing. The drive unit usually comprises a pair of gears, the first one being attached to a motor shaft and the second one being attached to a pin that is integral with the door panel.

Said doors with automatic opening and closing are impaired by some problems related with reliability and safety. In fact, if a limb of the user (an arm, a hand or a finger) is accidentally positioned along the trajectory of the door panel during the opening or closing of the door panel, the limb can be trapped and crushed and possibly severely injured. In order to avoid such problems and in order to comply with the current safety standards, door manufacturers must ensure that the forces generated by the door panel when hitting a person or an obstacle are lower than the values set by the law in such a way that the door panel can stop or slow down during its movement in order to avoid crushing or injuring the user.

The compliance with said standards has been achieved by manufacturers of automated doors using electric motors that are suitably calibrated in such a way as to provide a force with minimum intensity that can be easily overcome by providing a minimum resistant force that is opposed to the motion of the door panel. However, in such a solution, the resistant force on the door panel is discharged directly on the motor, and this can result in a motor failure, if not in a motor breakage. Consequently, the motor will have to be replaced. Therefore, this solution is unreliable and expensive.

GB2345087 discloses a mechanism for opening and closing doors, said mechanism comprising an input shaft connected to a motor, an output shaft connected to the door and linking means.

EP2017423 discloses a device for the opening and closing of door panels, comprising a motor provided with a drive shaft located along a first axis, a reduction unit located along a second axis and capable of receiving the rotation of the drive shaft and transmitting it to an output shaft.

GB2264534 discloses a mechanism for the motorized opening and closing of a gate comprising a motor and a central shaft provided with a driven plate and pressure plates that form a clutch.

KR102015902 discloses an automatic device for opening and closing a door, comprising: a fixed pillar; a swivel pillar; a rotation driving means installed on the upper support of the pivotal column and transmitting a driving force to rotate the pivotal column and the door.

KR20020010284 discloses a hinge for an automatic door to reduce inconvenience on using of the door. The hinge comprises a motor and a speed reducer, a bevel gear and a clutch disk to transfer the power of the motor to a rotary shaft.

The purpose of the present invention is to eliminate the drawbacks of the prior art by providing an automated door suitable for protecting the electric motor and/or the drive means, when the door is hindered during its movement.

An additional purpose of the present invention is to disclose an automated door wherein, when the door panel is hindered in its free rotation, the resistance provided by the obstacle is not discharged on the drive means and/or on the electric motor.

A further purpose of the present invention is to disclose a reliable and safe automated door provided with a door panel with low thickness.

Another purpose is to disclose an automatic door wherein the lock can be moved automatically and manually quickly and easily, in the event of failure or malfunction of the automatic lock elements.

BRIEF SUMMARY OF THE INVENTION

These purposes are achieved according to the invention with the characteristics of the appended independent claim 1.

Advantageous embodiments appear from the dependent claims.

The door according to the invention is defined by claim 1.

BRIEF DESCRIPTION OF THE SEVERAL VIEWS OF THE DRAWINGS

For the sake of clarity, the description of the door according to the invention continues with reference to the appended drawings, which have a merely illustrative, not limiting value, wherein.

DETAILED DESCRIPTION OF THE INVENTION

With reference to the appended figures, a door with automatic opening and closing according to the present invention is disclosed, it being generally indicated with reference letter P.

Figure 1:
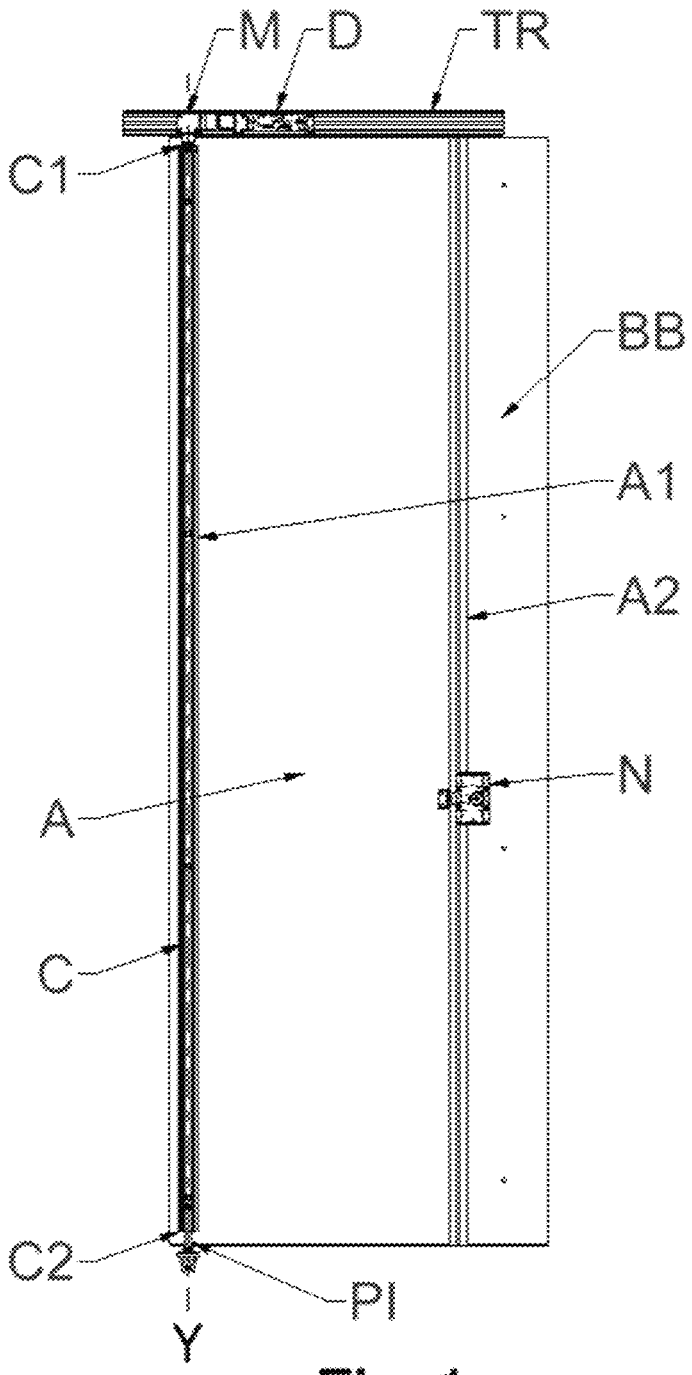
FIG. 1 is a partially sectioned interior view of the door according to the invention.
Figure 1A:
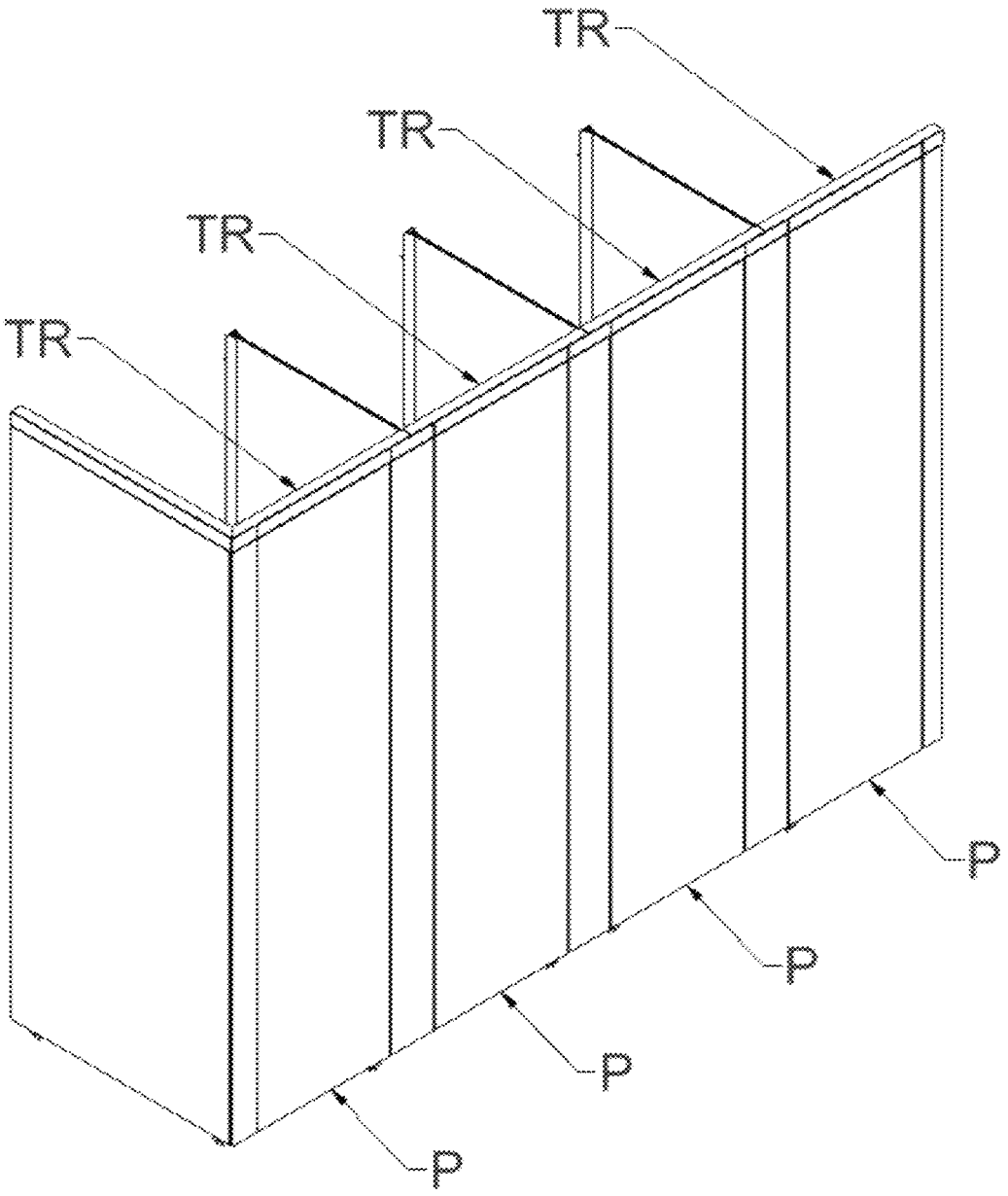
FIG. 1A is a perspective view that shows a plurality of public bathrooms in adjacent position, wherein the doors of the invention are installed.

The door (P) is suitable for being preferably installed in the opening that provides access to public bathrooms, such as the bathrooms of restaurants, highway rest areas and the like, as schematically shown for illustrative purposes in FIG. 1A.

With reference to FIG. 1, the door (P) comprises:

- a door panel (A) with a hinging side (A1) and a closing side (A2),
- a support column (C) fixed on the inside of the door (P) on the hinging side (A1) and suitable for rotating around a longitudinal axis (Y) of the column that extends vertically in such a way to move said door panel (A) between a closing position, wherein the door panel (A) closes the opening that provides access to the bathroom, and an opening position, wherein the door panel (A) does not close the opening that provides access to the bathroom.

The support column (C) has an upper end (C1) and a lower end (C2).

Although in the description the support column (C) is obtained separately from the door panel (A), the support column (C) may be integral with the door panel (A).

The door (P) includes a lower hinging pin (PI) having an axis that coincides with the longitudinal axis (Y) of the support column. The lower hinging pin (PI) is revolvingly inserted into a seat obtained in the lower end (C2) of the support column (C). Preferably, a bearing is provided between the lower hinging pin (PI) and the seat in order to reduce friction between said seat and said lower hinging pin (PI).

The door (P) further comprises an actuation assembly (O) disposed on the upper end (C1) of the support column.

Figure 2:
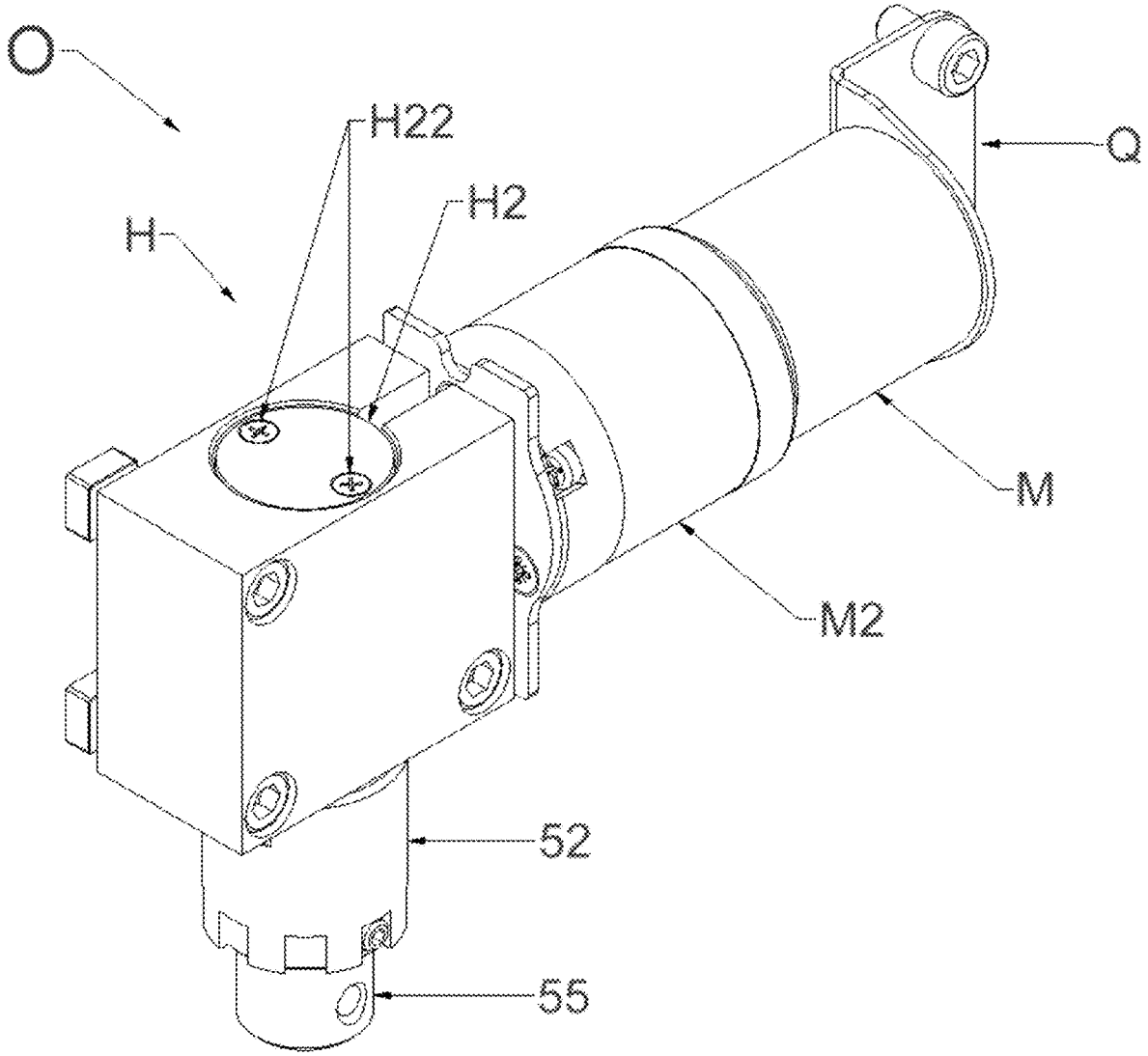
FIG. 2 is an axonometric view of the drive unit of the door according to the invention.
Figure 3:
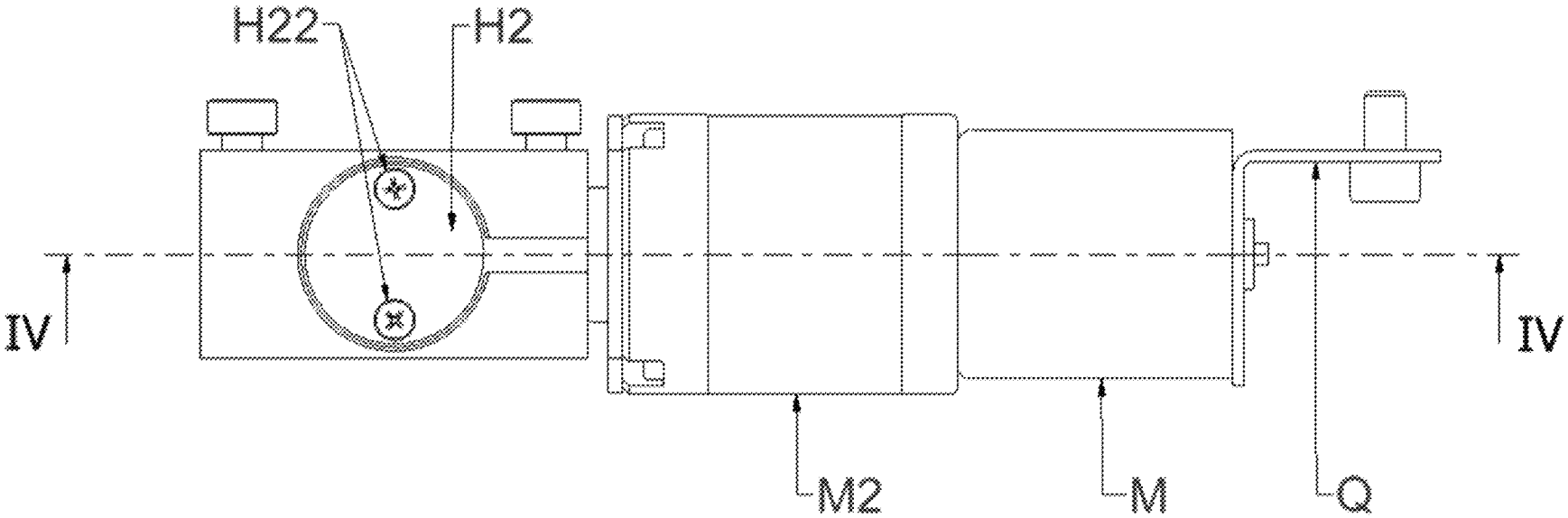
FIG. 3 is a top view of the drive unit of FIG. 2.
Figure 4:
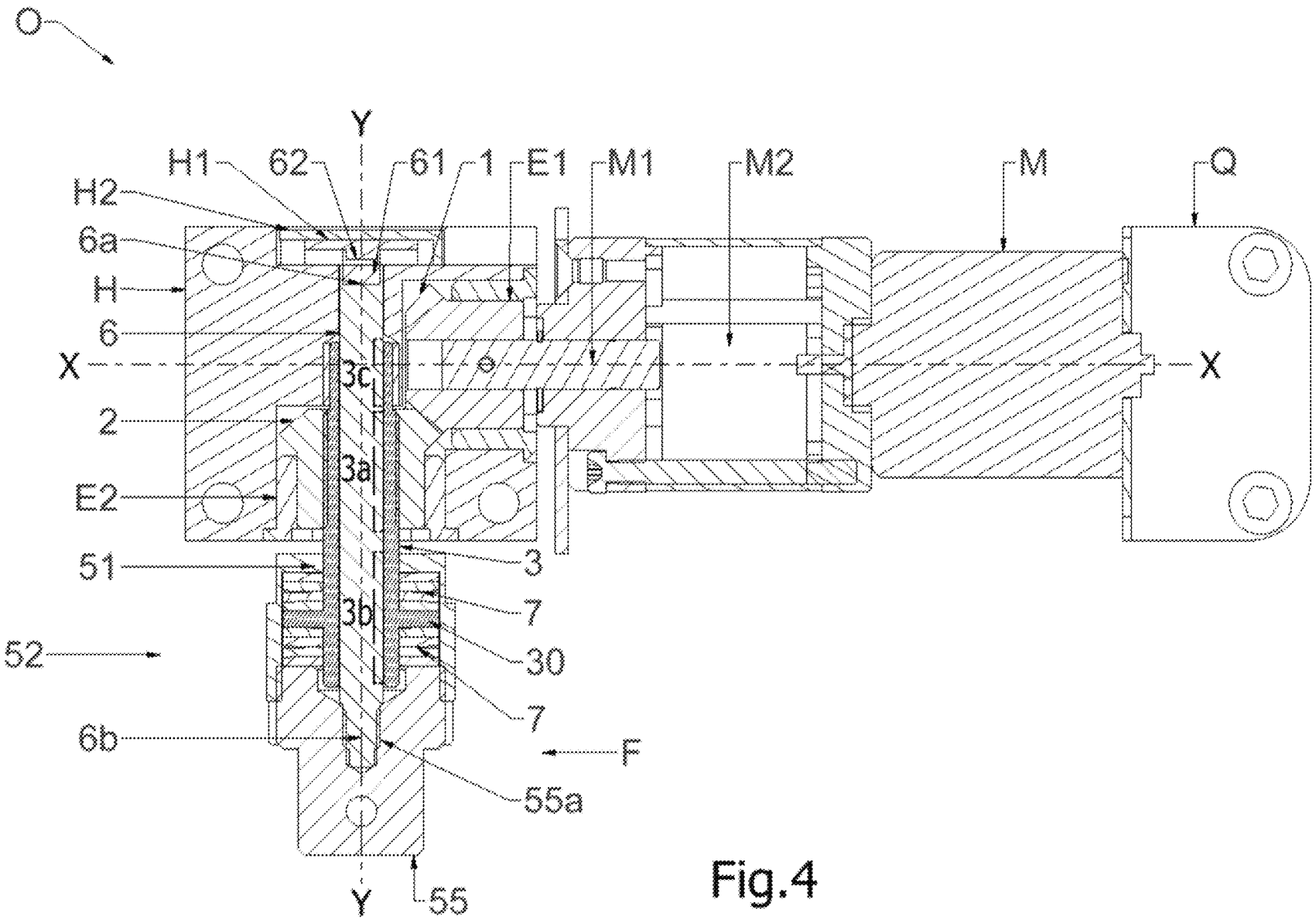
FIG. 4 is a view of the drive unit shown in FIG. 3 sectioned along the plane IV-IV.

With reference to FIGS. 2, 3 and 4, said actuation assembly (O) comprises an electric motor (M) with a shaft (M1) for moving the support column (C). Preferably, the electric motor (M) is a brushless electric motor. Advantageously, the electric motor (M) comprises a geared motor (M2) with the shaft (M1). The electric motor (M) is supported by a support frame (Q) suitable for being fixed to a crosspiece (TR) by means of fixing means, such as screws or the like.

The crosspiece (TR) may be incorporated directly into the bathroom where the door (P) is to be installed, or it may be an integral part of the door (P) and may be especially mounted in the opening that provides access to the bathroom.

With reference to FIG. 4, the shaft (M1) has an axis of rotation (X) disposed in substantially horizontal position when said motor (M) is mounted on the crosspiece (TR).

The door (P) is provided with a control unit (D) (shown in FIG. 1) that is operatively connected to the electric motor (M) in order to activate and/or deactivate the electric motor (M).

The actuation assembly (O) is also provided with a drive unit suitably configured for transmitting the motion from said electric motor (M) to said support column (C); said drive unit comprises a first drive element (E1) connected to the electric motor (M) and a second drive element (E2) connected to the support column (C).

The peculiarity of the door (P) according to the invention is that said drive unit comprises a clutch unit (F) that is interposed between the first drive element (E1) and the electric motor (M) or between the second drive element (E2) and the support column (C).

The clutch unit (F) is suitably configured in such a way that:

- the support column (C) is driven in rotation by the electric motor (M) when the door panel (A) is free to rotate; and
- the support column (C) is not driven in rotation by said electric motor (M) when the door panel (A) is accidentally hindered by a user or any other obstacle.

The clutch unit (F) acts as a safety system to prevent hand crushing. In fact, the friction unit (F) can block the door panel (A) during closing and opening if an obstacle interferes with the door panel (A), without blocking or offering resistance to the electric motor (M).

The clutch unit (F) is disposed between said second drive element (E2) and the support column (C).

The first drive element (E1) comprises a first gear (1) coupled with the shaft (M1) of the motor (M). The second drive element (E2) comprises a second gear (2) that engages with said first gear (1), and a central pin (3) integral with said second gear (2) which rotates about an axis coinciding with the axis of rotation (Y) of the support column (C).

Figure 2A:
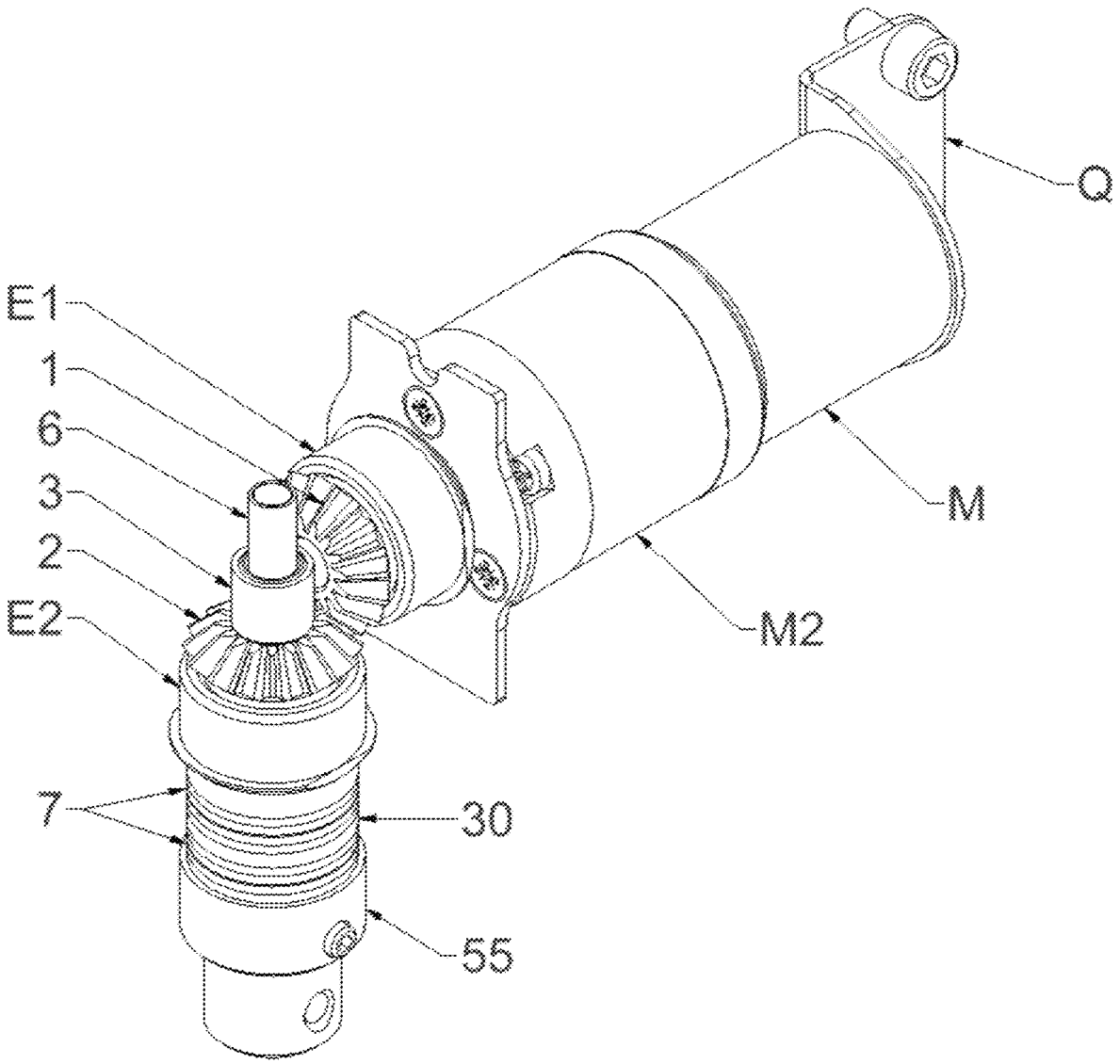
FIG. 2A is an axonometric view of the drive unit of FIG. 2 without the casing and the clutch means cover.

For illustrative purposes, as shown in FIG. 2A, the first gear (1) and the second gear (2) are bevel wheels that engage with each other. In such a case, said shaft (M1) and said central pin (3) are inclined to each other, in particular they are orthogonal to each other.

The central pin (3) comprises a central portion (3*a*), whereon said second gear (2) is splined and integral, a first ending portion (3*b*), facing the door panel (A), wherein said clutch unit (F) is disposed, and a second end section (3*c*) opposite to said first ending portion (3*b*).

The first gear (1), the second gear (2), the central portion (3*a*), and the second end section (3*c*) of the central pin (3) are housed within a suitably shaped casing (H).

The central pin (3) comprises an external flange (30) disposed on the ending portion (3*b*) of the central pin (3).

Although not shown in the appended figures, said first drive element (E1) and said second drive element (E2) may consist in surfaces coupled by interference hat integrally connect the shaft (M1) to the central pin (3). In such a case, the shaft (M1) and the central pin (3) are coaxial to each other.

Figure 4A:
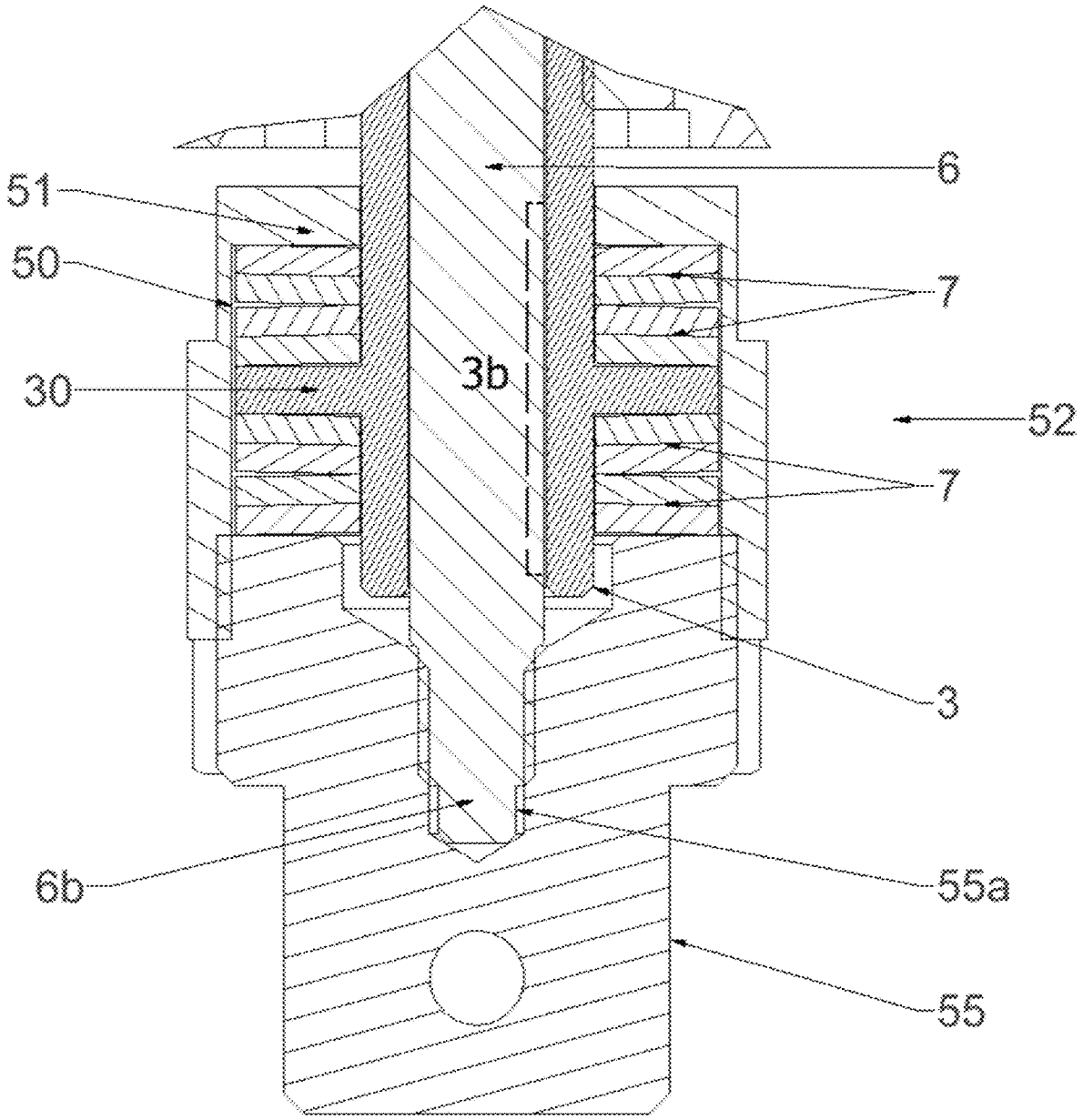
FIG. 4A is an enlarged detail of FIG. 4.

With reference to FIGS. 4 and 4A, said clutch unit (F) comprises:

- a first set of clutch disks (7) on the motor side, specifically four clutch disks (7), of which one has a side in contact with a motor side surface of the external flange (30);
- a second set of clutch disks (7) on the door panel side, specifically four clutch disks (7), of which one has a side in contact with a door panel side surface of the external flange (30);
- a cap (52) comprising a lateral wall (50) and a bottom wall (51) comprising a hole crossed by the central pin (3); the lateral wall (50) and the bottom wall (51) define a compartment wherein the external flange (30) of the central pin (3) and the clutch disks (7) are inserted; and
- a shank (55) suitable for closing the compartment defined by the cap (52) and integrally connected with the support column (C).

Figure 4B:
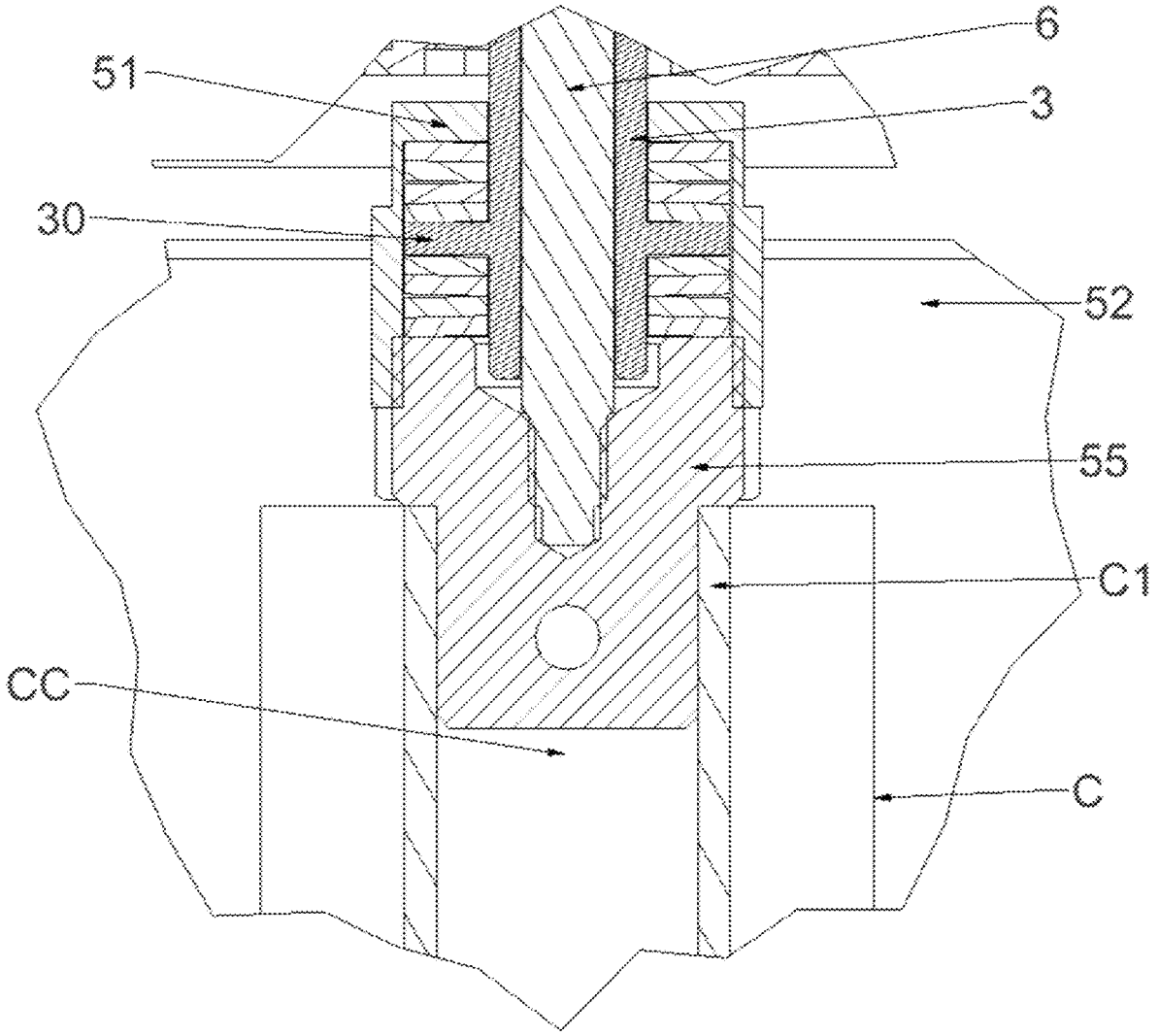
FIG. 4B shows the enlarged detail of FIG. 4A mounted on the support column.

As shown in FIG. 4B, the shank (55) is threaded into a seat (CC) obtained on the upper end (C1) of the support column (C). Said shank (55) is fixed to said seat (CC) by means of interference or by means of fixing means, such as screws.

Advantageously, the shank (55) is coupled to the lateral wall (50) of the cap (52) by means of a thread in such a way that the shank (55) can be more or less screwed in order to press the clutch-disks (7) against the external flange (30) of the central pin (3) with a higher or a lower force.

Advantageously, said clutch disks (7) consist in Belleville springs.

When the shank (55) is screwed or unscrewed with respect to the cap (52), the Belleville springs are axially loaded with a higher or a lower load, which results in a higher or a lower pressure acting on the sides of the external flange (30), on the bottom wall (51) of the cap (52), and on the shank (55). In this way, the coupling force used for coupling the central pin (3) with the cap (52) and with the shank (55) can be adjusted.

The more the shank (55) is screwed into the cap (52), the stronger the resistant force to be applied to the door panel (A) will have to be in order to ensure that said central pin (3) rotates in idle with respect to the cap (52) and the tang (55) and that said electric motor (M) does not drive the door panel (A) into rotation.

Although not shown in the appended figures, said clutch unit (F) may also comprise only one clutch disk having a side in contact with said external flange (30), and a surface integral with the door panel (A) that presses said clutch disk against the external flange (30).

Preferably with reference to FIGS. 4, 4A and 4B, the central pin (3) is a hollow pin wherein a bar (6) is inserted, said bar (6) being provided with an end head (6*a*) that protrudes in upper position from the second ending section (3*c*) of the hollow pin (3), and an end point (6*b*) that comes out of said first ending portion (3*b*) of the hollow central pin (3).

The bar (6) is integrally coupled with said shank (55). In particular, said shank (55) comprises a central seat (55*a*) wherein the end point (6*b*) of the bar (6) is inserted. In order to ensure a stable connection between the bar (6) and the shank (55), said end point and said central seat (55*a*) comprise threads suitable for being coupled to each other.

With reference to FIG. 4, the end head (6*a*) of the bar (6) ends into a circular seat (H1) of the casing (H) formed on an upper wall of the casing (H). Such a circular seat (H1) is closed by a plug (H2). The plug (H2) is firmly fixed to the casing (H) by means of fixing screws (H22).

The door (P) also comprises:

- a magnet (61) with diametral polarization fixed at the end head (6*a*) of the bar (6);
- a magnetic field detector (62) disposed on said circular seat (H1), suitable for detecting the magnetic field generated by the magnet (61) with diametral polarization according to which the position of the door panel (A) is defined.

The magnetic field detector (62) is operatively connected to the control unit (D) in order to send a signal about the position of the door panel (A) to said control unit (D). When the support column (C) rotates about its longitudinal axis (Y), also the bar (6) rotates, thus changing the orientation of the magnet (61) accordingly.

Each orientation of the magnet (61) corresponds to a given magnetic field detected by the magnetic field detector (62).

According to the magnetic field detected by the magnetic field detector (62), the control unit (D) can determine the position of the door panel (A).

Said control unit (D) will deactivate the motor (M) only when the magnet (61) is oriented in a position that corresponds to the moment when said door panel (A) is in one of the two end-of-travel positions.

According to an alternative embodiment of the invention, said bar (6) may consist in a magnet with diametral polarization.

Figure 5A:
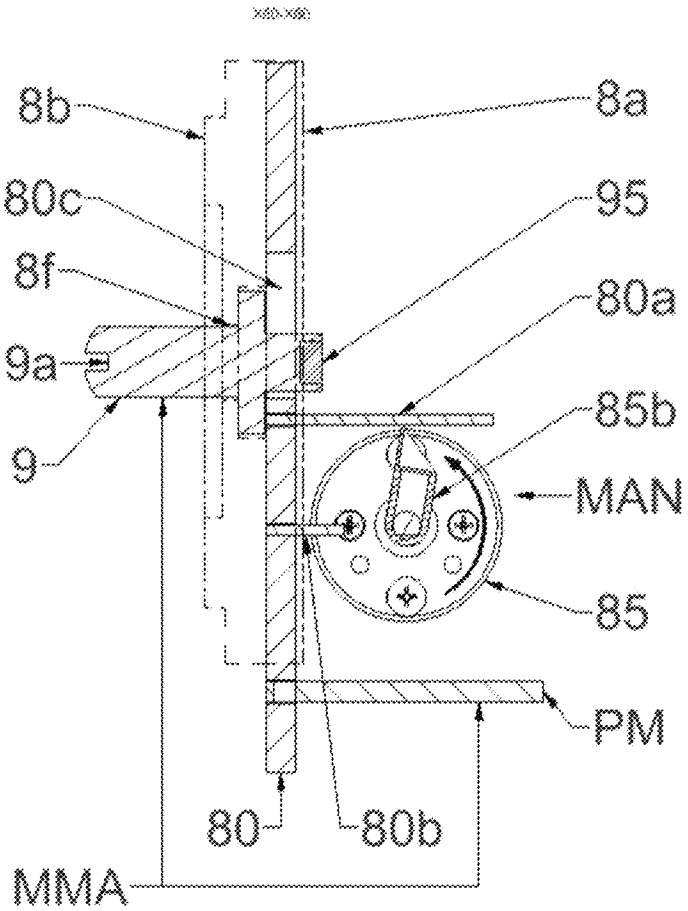
FIG. 5A is a view of the lock of FIG. 5 sectioned along a horizontal plan passing through the longitudinal axis of the mobile plate.
Figure 5:
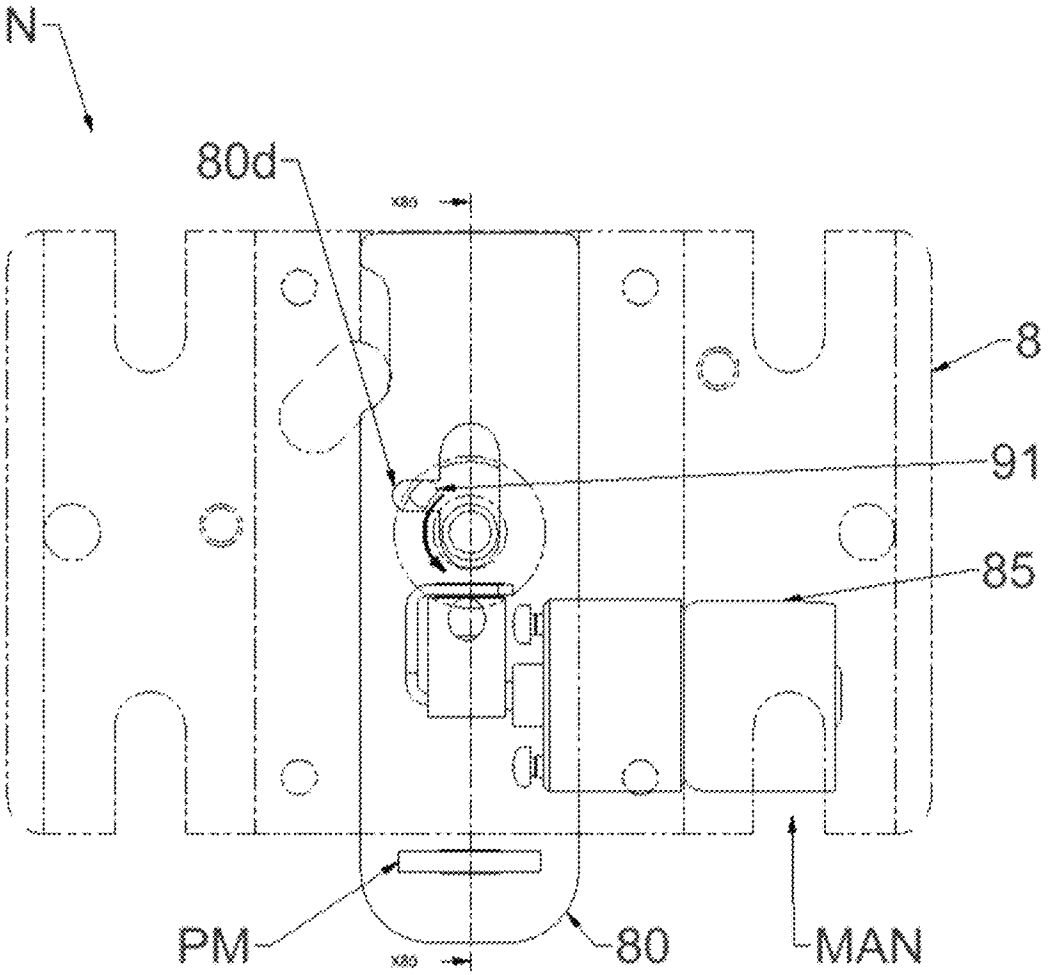
FIG. 5 is a front view of the lock of the door according to the invention, with the mobile plate in retracted position.
Figure 5B:
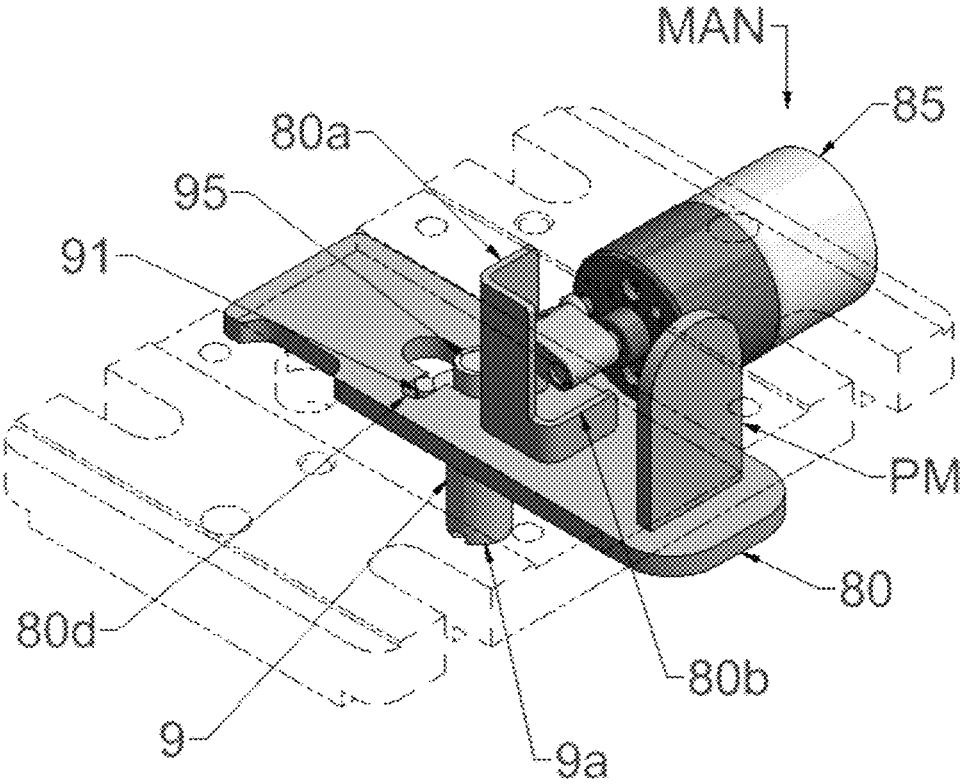
FIGS. 5B and 5C are a perspective view and a top view of the lock of the door according to the invention, respectively, with the mobile plate in retracted position.
Figure 5C:
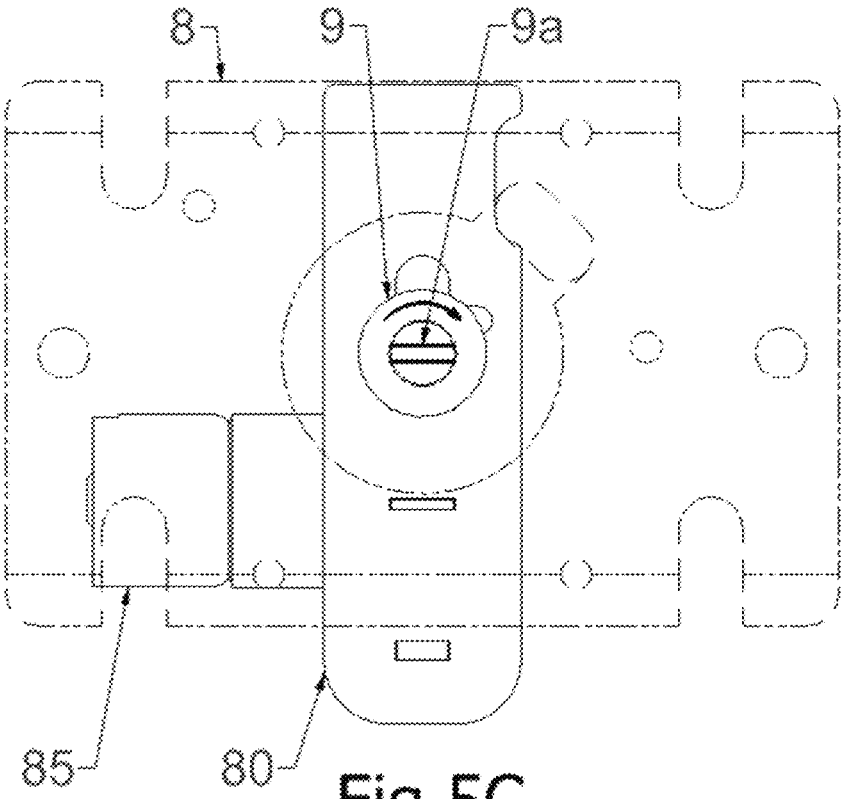
Figure 6A:
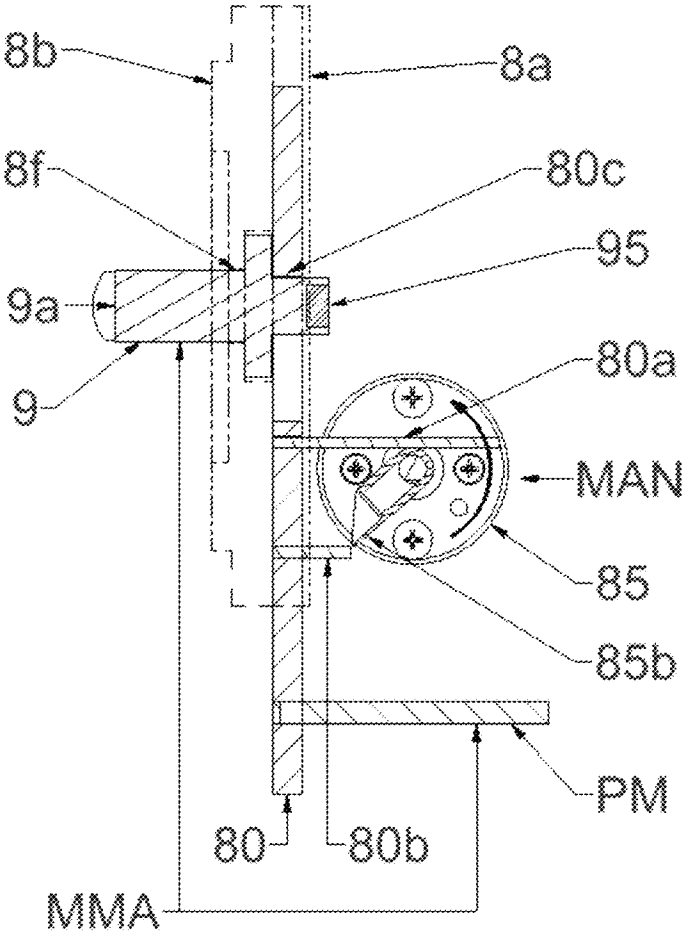
FIG. 6A is a view of the lock of FIG. 6 sectioned along a horizontal plan passing through the longitudinal axis of the mobile plate.
Figure 6:
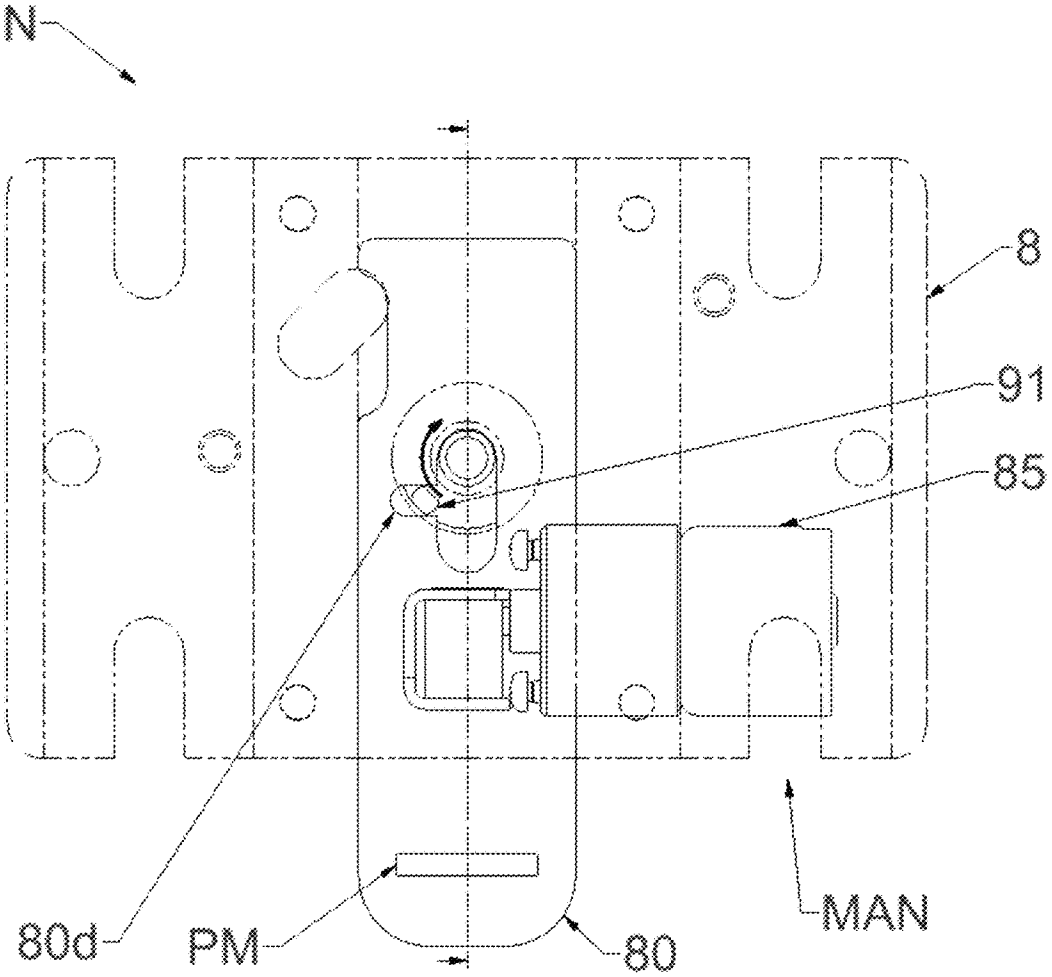
FIG. 6 is a front view of the lock of the door according to the invention, with the mobile plate in extracted position.
Figure 6B:
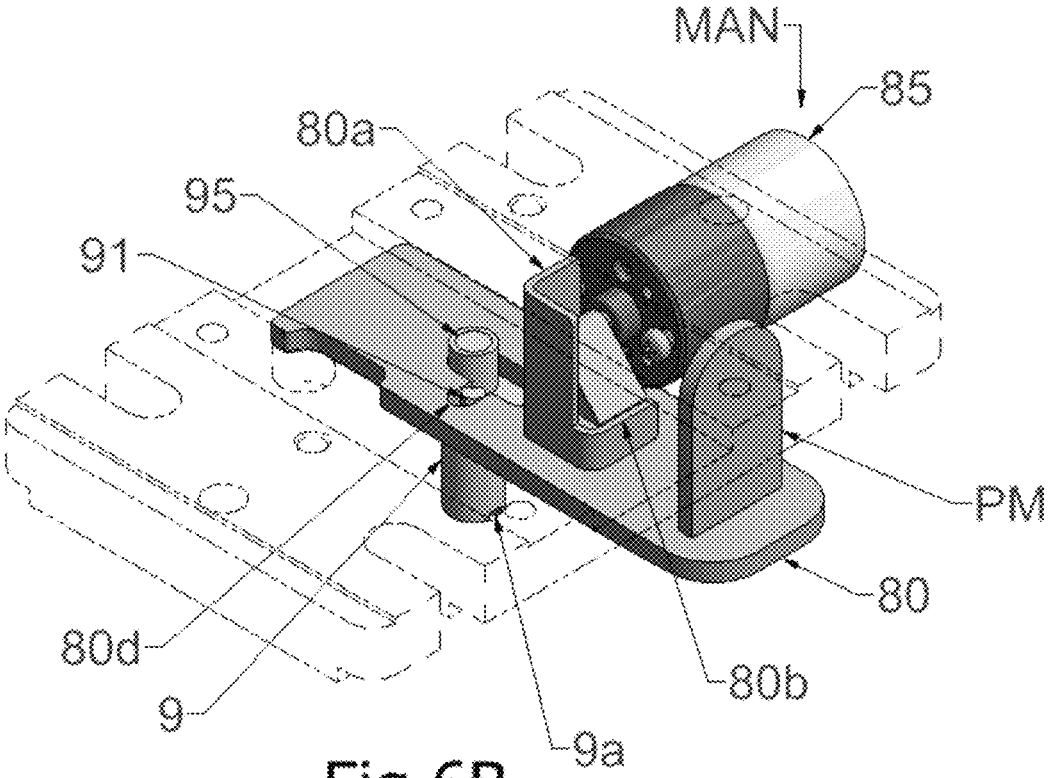
FIGS. 6B and 6C are a perspective view and a top view of the lock of the door according to the invention, respectively, with the mobile plate in extracted position.
Figure 6C:
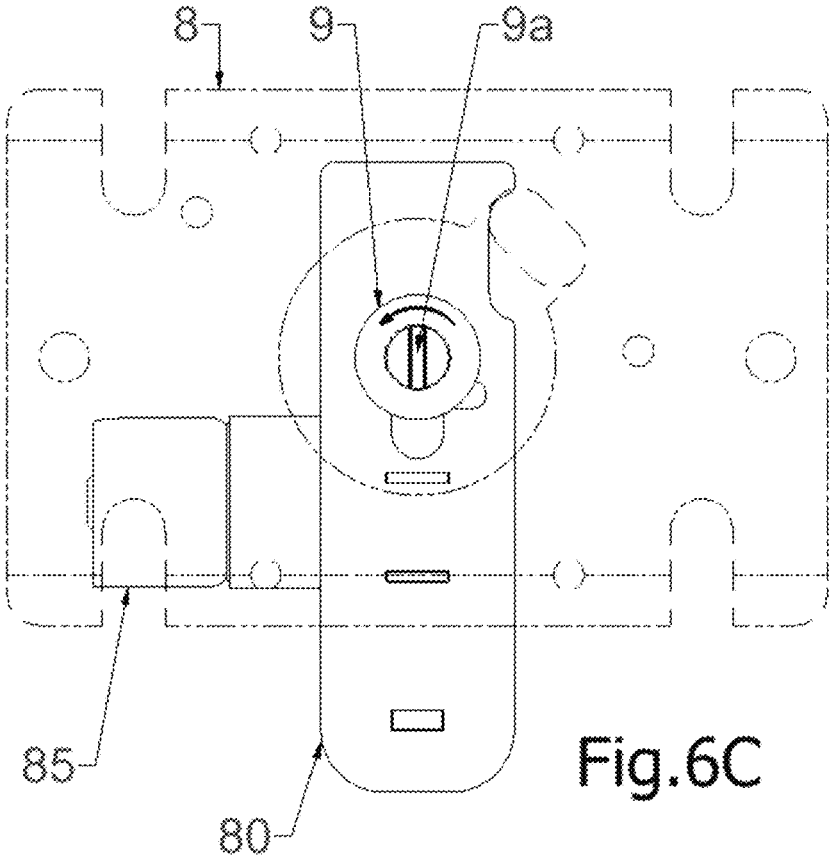

With reference to FIGS. 5 to 6C, said door (P) comprises a lock (N) comprising a frame (8) fixed to a vertical stop wall (BB) (shown in FIG. 1).

The vertical stop wall (BB) may be incorporated directly into the bathroom where the door (P) is to be installed, or it may be an integral part of the door (P) and may be especially mounted in correspondence with the opening that provides access to the bathroom. Said frame (8) of the lock (N) comprises two opposing sides (8*a*, 8*b*), namely a first side (8*a*) and a second side (8*b*). In particular, said first side (8*a*) of the frame (8) will be suitable for facing the interior of the bathroom, whereas the second side (8*b*) of the frame (8) will be suitable for facing the exterior of the bathroom.

The lock (N) comprises a movable plate (80) having a longitudinal axis (X80) and mounted slidingly on a guide formed along the frame (8) in such a way that said movable plate (80) can slide in parallel direction and can be moved between a retracted position and an extracted position.

The lock (N) includes automatic moving means (MAN) for automatically moving the plate (80) between said extracted position and said retracted position. The automatic moving means (MAN) are operatively connected to said control unit (D) in order to receive an activation signal from the control unit (D).

The automatic moving means (MAN) comprise:

- an electric motor (85) having a spindle; and
- a shaped arm (85*b*) integrally connected to the spindle suitable for selectively interfering against first backing means (80*a*) and second backing means (80*b*) integral with the movable plate (80), during the rotation of the shaft (M1), in such a way as to push said movable plate (80) to said retracted position or to said extracted position.

Said backing means (80*a*, 80*b*) preferably comprise two backing walls parallel to each other that protrude orthogonally from said movable plate (80).

Said lock (N) further comprises manual moving means (MMA) for moving the lock (N) manually.

In particular, said lock (N) comprises manual moving means (MMA) of internal type, that is to say of the type that can be moved manually by a user positioned opposite the first side (8*a*) of the frame (8), and manual moving means (MMA) of external type, that is to say of the type that can be moved manually by a user positioned opposite the second side (8*b*) of the frame (8).

The manual moving means (MMA) of external type comprise:

- a projecting pin (9) that protrudes from the second side (8*b*) of the frame (8) provided in its end section with a notch (9*a*) for holding a handling tool or a coin; said projecting pin (9) is rotatably inserted in idle into a hole (8*f*) of the frame (8) and is also inserted in a slot (80*c*) obtained on the movable plate (80); and
- a tooth (91) integral with said projecting pin (9) that engages with a corresponding niche (80*d*) obtained on said movable plate (8), which cooperates with said niche (80*d*) in such a way as to push said niche (80*d*) during the rotation of the projecting pin (9) or in such a way as to be pushed by said niche (80*d*) during the movement of said movable plate (80) by means of said automatic moving means (MAN).

The manual moving means (MAN) of external type allow a user, who is positioned outside the bathroom, that is to say in front of the second side (8*b*) of the frame (8) of the lock (N), to move the movable plate (80) by inserting a tool or a coin into the notch (9*a*) and rotating said projecting pin (9).

On the other hand, the manual moving means (MAN) of internal type consist of a manual gripping member (PM) (such as a lever), which is fixed to the plate (80) and protrudes from the first side (8*a*) of the frame (8). The manual gripping member (PM) is suitable for being grabbed by a user position opposite the first side (8*a*) of the frame in order to move said plate (80) to the extracted position or to the retracted position.

The lock (N) further comprises a detection unit of the position of the movable plate comprising:

- a magnet (95) with diametrical polarization integral with said projecting pin (9);
- a magnetic detector (not shown in the appended figures) fixed to the frame (8) and capable of detecting the magnetic field generated by the magnet (95) according to which the position of the movable plate (80) is defined; the magnetic detector is operatively connected to said control unit (D) in order to send a signal indicating the position of the movable plate (80).

Preferably, said magnet (95) is disposed in a seat obtained on an end opposite to the end section wherein said notch (9*a*) of the projecting pin (9) is obtained.

Preferably, said lock (N) also comprises detectors suitable for detecting the presence of a hand in the proximity of the lock (N). Advantageously, said detectors are disposed on the two sides (8*a*, 8*b*) of the lock (N) such that the presence of a hand can be detected both inside the bathroom and outside the bathroom.

For illustrative purposes, said detectors may consist in photocells. In this way, in order to move the door panel (A), the user does not need to touch any part of the door panel (A), such as a knob, a handle, or a button, but only needs to bring his hand close to the lock (N) in such a way that the door panel (A) will automatically start moving from the closed position to the open position.

Although not shown in the appended figures, the door (P) can also be associated with a system used to detect and inform the presence of a user. More precisely, said system will be connected to said control unit (D) of door (P) and will comprise detection means suitable for detecting the presence of a user inside the bathroom and signaling means disposed outside the bathroom suitable for signaling the presence of a user inside the bathroom, or, otherwise said, suitable for signaling the occupancy of the bathroom.

For illustrative purposes, said detection means may consist in photocells, ultrasonic sensors or weight sensors disposed on the floor of the bathroom in order to detect the presence or absence of a user inside the bathroom. The signaling means may comprise LEDs of different colors to indicate to a user outside the bathroom whether the bathroom is occupied or not by another user.

Below is a description of the standard operation of the door (P) according to the invention installed in the opening that provides access to a public bathroom.

When the door panel (A) is closed and the bathroom is unoccupied, the signaling means will indicate that the bathroom is not used, for example by the lighting of a green LED. In order to enter the bathroom, the user will put his hand close to the lock (N) where said detectors are disposed. The detectors detect the presence of the hand and send a detection signal to the control unit (D) which activates the electric motor (M). When activated, the electric motor (M) drives the door panel (A) into rotation from the closing position to the opening position.

When the door panel (A) is positioned in the opening position, a predefined time is waited (such as 2-3 seconds), and then the control unit (D) sends a new activation signal to said electric motor (M) which is activated again, moving the door panel (A) from the opening position to the closing position.

In the meantime, the detection means of the presence detection and signaling system will detect the presence of the user inside the bathroom and the presence of the user is signaled outside the bathroom by turning off the green LED and turning on a red LED, for instance.

When the door panel has reached the closing position, the automatic moving means (MAN) of the lock (N) are immediately activated, moving the mobile plate (80) from the retracted position to the extracted position, so that said mobile plate (80) is inserted into a slot obtained on the door panel (A), thus locking the door panel (A) in said closing position.

In order to exit the bathroom, the user will put his hand near the lock (N) again. The detectors detect the presence of the hand and again send a detection signal to the control unit (D), which will again activate the automatic moving means (MAN) of the lock (N) and the electric motor (M). Then, the movable plate (80) moves from the extracted position to the retracted position, and the electric motor (M) rotates the door panel (A) from the closing position to the opening position, allowing the user to cross the opening and exit the bathroom.

If, during the closing of the door panel (A), an obstacle (such as a hand) provides resistance to the closing of the door panel (A), because of the aforementioned clutch unit (F), the door panel (A) integral with the bar (6) through the shank (55) will be blocked whereas the central pin (3), which is moved by the electric motor (M), will continue to rotate in idle, thus not transmitting the movement to the support column (C).

When the obstacle is removed from the door panel (A), the door panel (A) will resume its travel, being driven into rotation by the electric motor (M); due to the fact that the control unit detects the position of the door panel defined by the magnet (61), the door panel can return to the closing position.

Although it has always been assumed that the door (P) is preferably installed in public bathrooms, such a door can be used in different settings, for example other public areas, such as dressing rooms, locker rooms or offices.

Although the lock (N) is fixed to the vertical stop wall (BB), and the slot for the insertion of the plate (80) is obtained on the door panel (A), the position of the two elements can be switched, meaning that the lock is fixed to the door panel (A) and the slot is obtained on the vertical stop wall (BB).

Figure 7:
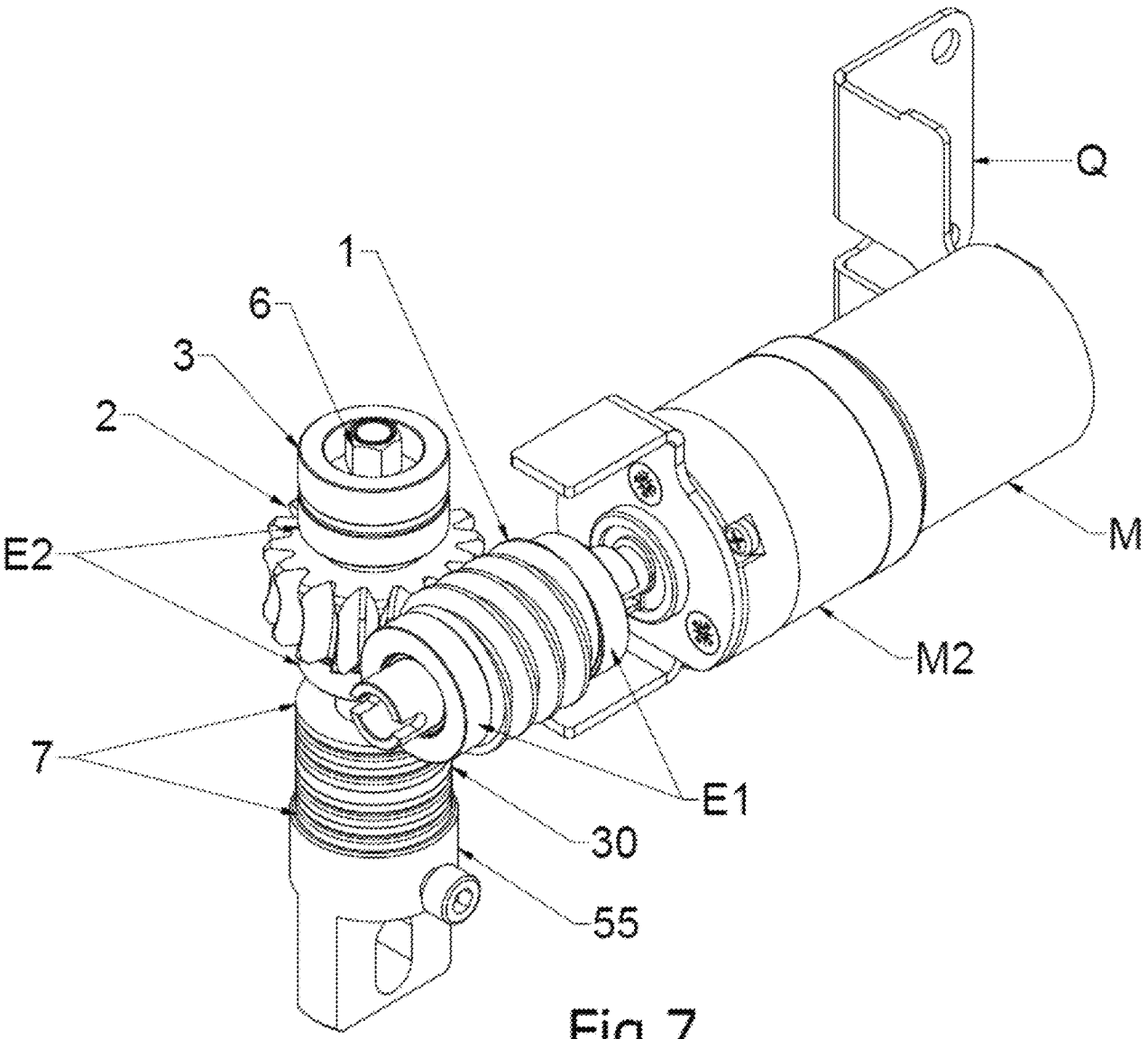
FIG. 7 is an axonometric view like FIG. 2A, which shows a variant of the drive unit.

With reference to FIG. 7, the first gear (1) and the second gear (2) can be a worm screw and a toothed crown, respectively. Also in such a case, the shafts of the gears are orthogonal to each other and the transmission between the first element (E1) and the second element (E2) is obtained by means of coupling between the worm screw and the toothed crown.

We claim:

1. A door with automatic opening and closing, the door comprising:

a door panel with a hinging side and a closing side;

a support column fixed to the hinging side of said door panel and adapted to rotate around a longitudinal axis of said support column to move said door panel between two end-of-travel positions;

an electric motor cooperative with said support column so as to actuate said support column, said electric motor having a shaft with an axis of rotation;

a drive unit that transmits motion from said electric motor to said support column, said drive unit having a first drive element connected to said electric motor and a second drive element connected to said support column;

a control unit operatively connected to said electric motor to activate or deactivate said electric motor, wherein said drive unit has a clutch unit interposed between the second drive element and said support column, said clutch unit being configured in such a way that said support column is driven in rotation by said electric motor during a rotation of said door panel, said support column is not driven in rotation by said electric motor during a hindering of the rotation of said door panel, wherein said first drive element has a first gear coupled with the shaft of said motor, said second drive element has a second gear that engages with the first gear and has a central pin integral with the second gear that rotates around an axis that coincides with the axis of rotation of the support column, upon which the central pin has a central portion wherein said first gear is fitted and an ending portion facing said door panel, wherein said clutch unit is disposed in the ending portion, the central pin has an external flange disposed on the ending portion of the central pin, wherein the clutch unit comprises:

a first clutch disk on a side of said electric motor, said first clutch disk having a side in contact with a motor side surface of the external flange;

a second clutch disk on a side of said door panel, said second clutch disk having a side in contact with a surface on a door panel side of the external flange;

a cap having a lateral wall and a bottom wall that define a compartment where the external flange of the central pin, the first clutch disk and the second clutch disk are received, the bottom wall of the compartment having a hole that receives the central pin; and a shank adapted to close the compartment, said shank integrally connected with said support column.

2. The door of claim 1, wherein said shank is coupled to a lateral wall of a cap by a thread such that the shank can be screwed in order to press said first and second clinch disks against the external flange of the central pin.

3. The door of claim 1, wherein the central pin is a hollow pin, the door further comprising:

a bar inserted into the hollow pin, said bar having an end head and a point end that projects from an ending portion of the hollow pin, the point end being integrally coupled with a central housing of said shank;

a magnet having diametrical polarization fixed at the end head of said bar; and a magnetic detector adapted to detect a magnetic field generated by said magnet so as to define a position of said door panel, said magnetic detector being operatively connected to said control unit so as to send a position signal relative to a position of said door panel.

4. The door of claim 1, further comprising:

a lock having a frame fixable to a vertical stop wall that is adapted to stop said door panel, the frame having a first side opposite a second side, said lock comprising:

a mobile plate that is slidingly mounted on the frame so as to be movable between a retracted position and an extracted position; and an automatic mover adapted to move said mobile plate between the extracted position and the retracted position, said automatic mover being operatively connected to said control unit to receive an activation signal from said control unit.

5. The door of claim 4, wherein said mobile plate has a first backing and a second backing, said automatic mover comprising:

another electric motor having a spindle; and a shaped arm connected to the spindle and adapted to selectively bear against the first backing and the second backing of said mobile plate so as to push said mobile plate towards the retracted position or towards the extracted position.

6. The door of claim 4, wherein said lock has a manual mover for said mobile plate, the manual mover composing:

a projection pin having a notch in an ending section thereof, the notch adapted to hold a maneuvering tool or a coin, said projecting pin being inserted in a hole of the frame, said projection pin being inserted in a slot formed on said mobile plate; and a tooth integral with said projecting pin, said tooth engaging with a niche formed on said mobile plate so as to cooperate with the niche so as to push the niche during a rotation of said projecting pin or to be pushed by the niche when said mobile plate is moved by said automatic mover.

7. The door of claim 6, further comprising:

a detector unit that detects a position of said mobile plate.

8. The door of claim 7, wherein said detector unit comprises:

a magnet having diametrical polarization, said magnet being integral with said projecting pin;

a magnetic detector adapted to detect a magnetic field generated by said magnet that defines the position of said mobile plate, said magnetic detector being operatively connected t said control unit in order to send a signal that indicates the position of said mobile plate.

9. The door of claim 4, further comprising:

a detector unit that detects a position of said mobile plate.

10. The door of claim 1, wherein each of the first gear and the second gear is a bevel wheel.

11. The door of claim 1, wherein the first gear and the second gear are a worm screw and a toothed wheel, respectively.

* * * * *